US005522375A

United States Patent [19]

Simo et al.

[11] Patent Number: 5,522,375

[45] Date of Patent: Jun. 4, 1996

[54] ARCHERY ACCESSORY ADAPTER

[75] Inventors: Miroslav A. Simo, Riverside; Robert S. Mizek, Downers Grove, both of Ill.

[73] Assignee: New Archery Products Corp., Forest Park, Ill.

[21] Appl. No.: 367,561

[22] Filed: Jan. 3, 1995

Related U.S. Application Data

[63] Continuation-in-part of Ser. No. 179,628, Jan. 7, 1994, which is a continuation-in-part of Ser. No. 986,717, Dec. 8, 1992, Pat. No. 5,359,984, which is a continuation-in-part of Ser. No. 710,032, May 31, 1991, Pat. No. 5,179,930, which is a continuation-in-part of Ser. No. 693,776, Apr. 26, 1991, Pat. No. 5,148,796, which is a continuation of Ser. No. 418,190, Oct. 6, 1989, abandoned, which is a continuation-in-part of Ser. No. 170,161, Mar. 18, 1988, Pat. No. 4,881,515, which is a continuation-in-part of Ser. No. 57,383, Jun. 2, 1987, Pat. No. 4,809,670, which is a continuation-in-part of Ser. No. 788,486, Oct. 17, 1985, Pat. No. 4,732,135, which is a continuation-in-part of Ser. No. 482,186, Apr. 5, 1983, Pat. No. 4,548,188.

[51] Int. Cl.[6] ..... F41B 5/14; F41B 5/22

[52] U.S. Cl. ..... 124/86; 124/44.5; 403/380

[58] Field of Search ..... 124/23.1, 24.1, 124/25.6, 44.5, 86, 87, 88, 89; 33/265; 403/188, 200, 384, 380, 388, 408.1

[56] References Cited

U.S. PATENT DOCUMENTS

| | | | |
|---|---|---|---|
| 2,234,557 | 3/1941 | Hungerford | 403/200 X |
| 3,108,584 | 10/1963 | Coe . | |
| 3,232,286 | 2/1966 | Guyton . | |
| 3,482,563 | 12/1969 | Pint . | |
| 3,757,764 | 9/1973 | Ikeya | 124/44.5 |
| 3,769,956 | 11/1973 | Simo | 124/44.5 |
| 3,828,757 | 8/1974 | Finlay | 124/44.5 |
| 3,890,951 | 6/1975 | Jennings et al. | 124/44.5 |
| 4,074,674 | 2/1978 | Simo | 124/44.5 |
| 4,119,078 | 10/1978 | Wilson et al. | 124/44.5 |
| 4,170,980 | 10/1979 | Killian | 124/44.5 |
| 4,215,666 | 8/1980 | Carroll et al. | 124/44.5 |
| 4,278,066 | 7/1981 | Zinz, Sr. | 124/44.5 |
| 4,489,704 | 12/1984 | Troncoso, Jr. | 124/24.1 |
| 4,592,332 | 6/1986 | Topping | 124/44.5 |
| 4,704,800 | 11/1987 | Stinson | 33/265 |
| 4,715,355 | 12/1987 | Latting | 124/44.5 |
| 4,732,135 | 3/1988 | Simo | 124/44.5 |
| 4,748,964 | 8/1988 | Troncoso, Jr. | 124/44.5 |
| 4,788,961 | 12/1988 | Toth | 124/24.1 |
| 4,898,145 | 2/1990 | Simo | 124/44.5 |
| 4,911,137 | 3/1990 | Troncoso | 33/506 |
| 4,924,841 | 5/1990 | Smith | 124/44.5 |
| 5,042,450 | 8/1991 | Jacobson | 124/44.5 |
| 5,050,576 | 9/1991 | Larson | 124/87 |
| 5,076,522 | 12/1991 | Stinson | 124/88 X |
| 5,081,980 | 1/1992 | Newbold | 124/44.5 |
| 5,117,803 | 6/1992 | Johnson | 124/44.5 |
| 5,144,937 | 9/1992 | Colvin | 124/44.5 |
| 5,148,796 | 9/1992 | Simo | 124/44.5 |
| 5,161,515 | 11/1992 | Hammonds | 124/44.5 |
| 5,239,977 | 8/1993 | Thomas | 124/89 |
| 5,265,585 | 11/1993 | Stinson | 124/88 |
| 5,285,767 | 2/1994 | Padilla | 124/87 |
| 5,341,791 | 8/1994 | Shafer | 124/87 |
| 5,394,859 | 3/1995 | Janeway | 124/87 |
| 5,400,764 | 3/1995 | Spolar et al. | 124/88 |
| 5,428,901 | 7/1995 | Slates | 33/265 |

FOREIGN PATENT DOCUMENTS

| | | |
|---|---|---|
| 3424744 | 1/1986 | Germany . |

*Primary Examiner*—Eric K. Nicholson
*Assistant Examiner*—John A. Ricci
*Attorney, Agent, or Firm*—Speckman, Pauley & Fejer

[57] ABSTRACT

An archery accessory adapter apparatus including an adapter plate having at least one bore, and a locknut for allowing repeated mountings and demountings of an archery accessory from the bowriser portion of a bow, without the need for tools in the target or hunting field, and without requiring lateral readjustment of the archery accessory once mounted on the bowriser.

12 Claims, 14 Drawing Sheets

ARCHERY ACCESSORY ADAPTER

CROSS-REFERENCE TO RELATED APPLICATIONS

This application is a continuation-in-part of my earlier filed application, Ser. No. 08/179,628, filed Jan. 7, 1994, which is a continuation-in-part of my earlier filed application, Ser. No. 07/986,717, filed Dec. 8, 1992, now U.S. Pat. No. 5,359,984, which is a continuation-in-part of my earlier filed application, Ser. No. 07/710,032, filed May 31, 1991, now U.S. Pat. No. 5,179,930, which is a continuation-in-part of my earlier filed application, Ser. No. 693,776, filed Apr. 26, 1991, now U.S. Pat. No. 5,148,796, which is a continuation of my earlier filed application, Ser. No. 418,190, filed Oct. 6, 1989, now abandoned, which is a continuation-in-part of my earlier filed application, Ser. No. 170,161, filed Mar. 18, 1988, now U.S. Pat. No. 4,881,515, which is a continuation-in-part of my earlier filed application, Ser. No. 057,383, filed Jun. 2, 1987, now U.S. Pat. No. 4,809,670, which is a continuation-in-part of my earlier filed application, Ser. No. 788,486, filed Oct. 17, 1985, now U.S. Pat. No. 4,732,135, which is a continuation-in-part of my earlier filed application, Ser. No. 482,186, filed Apr. 5, 1983, now U.S. Pat. No. 4,548,188.

BACKGROUND OF THE INVENTION

1. Field Of the Invention

This invention relates to an archery accessory adapter which allows repeated mounting and demounting of an archery accessory from an archery bowriser, without tools, and without requiring lateral readjustment of the archery accessory after each mounting.

2. Description of the Prior Art

Conventional archery bowrisers typically have one or two bowriser bores for mounting archery accessories. An arrowrest is a typical archery accessory mounted in such a bowriser bore. Some conventional arrowrests may have a mounting shaft component which is threadedly engaged within the bowriser bore, and an arrow support component which enters the bowriser bore from the side of the bowriser opposite the mounting shaft, and detachably engages the mounting shaft. U.S. Pat. Nos. 4,170,980, 4,732,135, and 5,148,796 teach such arrowrests.

Archery accessories are often demounted from a bow for various reasons, such as for transporting the bow. A problem arises when remounting an arrowrest on a bowriser, because the lateral position of the mounting shaft with respect to the bowriser will change from its last mounted lateral position, by virtue of the rotation of the mounting shaft as it is positioned within the bowriser bore. Thus, it is difficult to retain a precise lateral position of an archery accessory with respect to the bowriser when the entire accessory is demounted and then remounted on the bow. Even a slightly altered lateral position of an arrowrest can result in significant angular inaccuracies over a distance that an arrow travels when discharged from the archery bow. Thus, each time an archery accessory such as an arrowrest is demounted and then remounted with respect to an archery bow, the archer must engage in a time-consuming process to precisely readjust and set the lateral position of the mounting shaft. This calibration process can involve repeated trial arrow shootings and incremental adjustments of the mounting shaft within the bowriser bore until the optimal lateral position of the arrowrest is determined and set. In addition, readjusting an archery accessory often requires cumbersome tools which must be transported to and from the target or hunting field.

U.S. Pat. No. 4,924,841 teaches an arrow guide which includes a hollow threaded fastener that extends through a bowriser bore and engages a hinge plate which supports an arrowrest lever rod. To demount the entire accessory, the hollow threaded fastener is rotated from the bowriser bore, which necessitates lateral readjustment of the accessory after remounting.

U.S. Pat. Nos. 3,890,951, 4,748,964, and 5,042,450 teach various archery arrowrests. U.S. Pat. No. 4,911,137 discloses an arrow-centering device. U.S. Pat. No. 5,161,515 teaches a reversible arrow holder and arrowrest apparatus.

U.S. Pat. No. 5,239,977 teaches an elbow for attaching archery accessories such as stabilizers to archery bows. U.S. Pat. No. 4,788,961 discloses a universal bracket for mounting multiple archery accessories on an archery bow.

None of the above patents provide a solution to an archer's problem of expending considerable time and effort readjusting an archery accessory after remounting it on a bow.

SUMMARY OF THE INVENTION

It is one object of this invention to provide an archery accessory adapter which allows repeated mounting and demounting of an archery accessory extending through a first bowriser bore, and maintains a precise lateral position of the archery accessory with respect to the archery bowriser after each repeated mounting.

It is another object of this invention to provide an archery accessory adapter which allows easy mounting and demounting of an archery accessory without the need for tools in the target or hunting field.

It is another object of this invention to provide an apparatus for mounting an arrowrest or other piece of equipment in an at rest position, wherein the arrowrest can be rotated with respect to an archery bow and then automatically returned to the original at rest position.

It is yet another object of this invention to provide an apparatus for mounting the arrowrest in the at rest position, wherein the arrowrest can move inward toward the archery bow and then automatically return to the at rest position when the force acting upon the arrowrest is removed.

It is still another object of this invention to provide an arrowrest that can be quickly disconnected from an archery bow and then instantly replaced in a precise and consistent position with respect to the bow.

These objects and others are achieved with an adapter plate having an internally threaded bore for receiving a mounting shaft of an archery accessory. A locknut can be positioned on the mounting shaft such that the surface of the locknut abuts the surface of the adapter plate or any intermediate element, and thus fixes the mounting shaft with respect to the adapter plate. The locknut preferably has an internally threaded set screw bore, within which a set screw can be mounted. The set screw can be rotated so an end of the set screw abuts the surface of the adapter plate or any intermediate element, and thus fixes the locknut with respect to the adapter plate. Thus, the adapter plate, the locknut, and the mounting shaft can be handled together as an integral unit. In this manner, the integral unit can be detachably mounted on a bowriser such that the mounting shaft is aligned with the first bowriser bore. Because the adapter plate, mounting shaft, set screw, and locknut are fixed with respect to one another, the adapter plate and mounting shaft can be repeatedly mounted on and demounted from the bowriser without affecting the precise lateral position of the mounting shaft with respect to the bowriser when mounted on the bowriser.

A suitable adhesive can be used to fix or attach a subplate, having a subplate bore for receiving the archery accessory, to the bowriser portion of the archery bow. The subplate may have external collars which correspond with mating bores in the adapter plate. With the adapter plate abutting the subplate, and the external collars extending into the mating bores, nuts or screws, depending on whether externally or internally threaded collars are used, can threadedly engage the collars and thus detachably secure the adapter plate to the subplate, which in turn is secured to the bowriser. The nuts or screws can have externally knurled surfaces to allow tightening by hand.

According to another preferred embodiment of this invention, a screw extends through a second adapter bore in the adapter plate, and threadedly engages a second bowriser bore and thus secures the adapter plate to the archery bow.

The above and other objects of this invention are further accomplished with a mounting apparatus having a housing with a longitudinal bore. A rod is slidably mounted within the longitudinal bore. After linear displacement of the rod with respect to the housing, the rod can be returned to its linear at rest position. Likewise, after rotational displacement of the rod with respect to the housing, the rod can be returned to its original rotational at rest position.

To accomplish the returnable plunger action of the rod with respect to the housing, a compression spring is mounted within the longitudinal bore. The compression spring has one end which is fixed with respect to the rod and an opposite end, the position of which can be fixed with respect to the housing to vary the length of the compression spring. A tension adjustment screw is mateable within an internally threaded bore for varying the length and thus adjusting the tension of the compression spring. A lock screw having external threads engageable with threads of the internally threaded bore of the housing can be abutted against the tension adjustment screw to lock the tension adjustment screw in place, with respect to the housing. In one preferred embodiment of this invention, the lock screw has a non-circular through bore and a tool, such as a screwdriver, can be inserted within the through bore in order to gain access to the tension adjustment screw. The non-circular through bore can have a polygonal shape, for example, to accommodate an Allen wrench. Thus, the tension adjustment screw and the lock screw can be rotated without removing either from the housing.

Other objects of this invention are accomplished with an arrowrest having a housing to which either a male or female adapter is connected. An opposite and mating adapter is preferably attached to a portion of the rod of the mounting apparatus. An arrow support arm has a riser portion and a support portion. The riser portion is hingedly mounted with respect to the housing. The riser portion of the arrow support arm is preferably mounted within a through bore of a bushing which is secured to the housing. In such embodiment, the riser portion is preferably mounted so that it has limited vertical movement. A return spring is mounted with respect to the arrow support arm so that the return spring urges the support portion into a rest position. An arrow shaft is loaded onto the arrowrest when the support arm is in the rest position.

The support portion of the arrow support arm has limited vertical movement. As the arrow is discharged, the support portion moves in a forward direction from the rest position to a deflected position. In one preferred embodiment according to this invention, the movement of the support portion is limited between the rest position and the deflected position with a spring clip that is secured to the housing. According to another preferred embodiment of this invention, a free end portion of the riser portion is bent or formed at an angle with respect to the riser portion. The free end portion preferably contacts a housing wall when the support portion is in the deflected position and contacts a detent of the spring clip when in the rest position.

The spring clip is preferably secured with respect to the housing. In one preferred embodiment according to this invention, the housing forms a groove in which the spring clip is mounted, preferably with an interference fit.

According to one preferred design of the spring clip and the arrow support arm, the support portion is able to deflect both in a forward direction, from the rest position to the deflected position, and in a backward direction, beyond the rest position of normal movement of the support portion. With such design, the support portion can be reset to the original rest position, particularly after such backward movement.

A cover is preferably secured to the housing so that the mechanical elements providing movement of the arrow support arm are not exposed. In another preferred embodiment according to this invention, the cover comprises a horizontal or lateral cushion for allowing a discharged arrow to force a contact portion of the housing in a horizontal or lateral direction, with respect to a vertically positioned archery bow. The contact portion is preferably spaced at a distance from an outer wall of the housing. The contact portion is hingedly mounted to the housing and the contact portion is urged or biased into a shooting position. The housing and the cover are each injection molded with a polymeric material, according to yet another preferred embodiment of this invention.

The above and other objects of this invention are still further accomplished with a quick disconnection between the arrowrest and the bow handle-riser portion of an archery bow which includes first connecting means fixed with respect to the bow handle-riser portion and second connecting means secured to the arrowrest. The first connecting means are non-rotatably mateable with the second connecting means. In a mounted position of the arrowrest with respect to the bow handle-riser portion, the first connecting means are secured to the second connecting means thereby locking the arrowrest in a fixed position. The first connecting means can be repeatedly positioned and instantly replaced in a precise and consistent position with respect to the bow. It is a very important aspect of this invention to have an arrowrest that can be instantly replaced in a precise and consistent position since a 1° to 2° misalignment of the arrowrest results in an error of about 2½ to 5 feet at a target positioned only 50 yards from the bow.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which.

DESCRIPTION OF THE PREFERRED EMBODIMENTS

Figure 1:
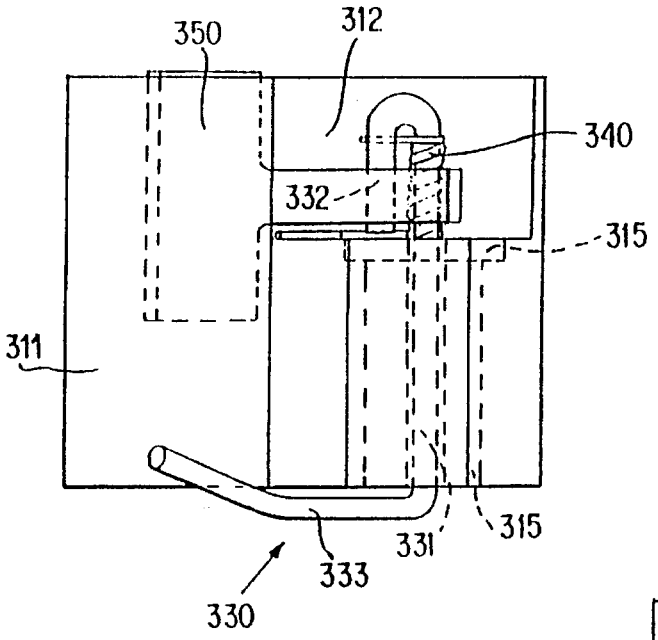
FIG. 1 is a front view of an arrowrest biased into a normal rest position, without a housing cover, according to one preferred embodiment of this invention.
Figure 2:
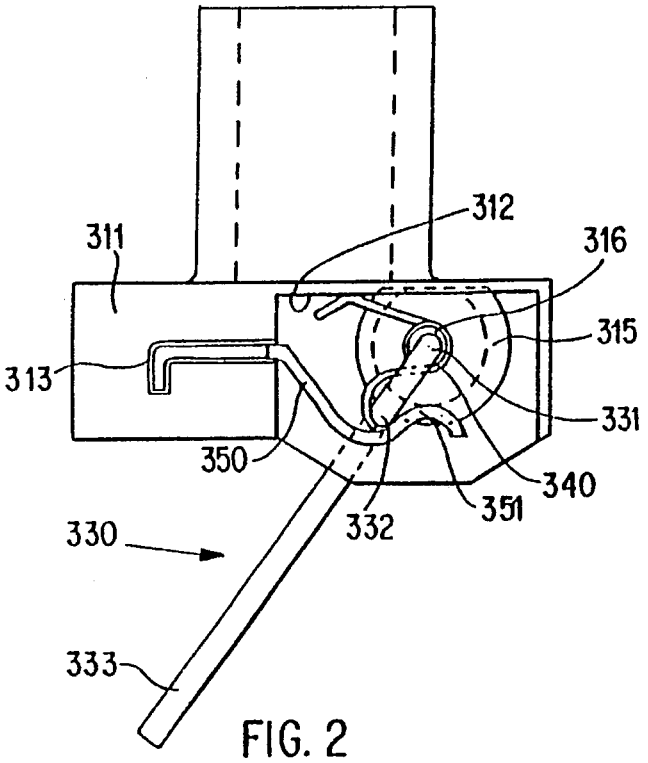
FIG. 2 is a top view of the arrowrest, as shown in FIG. 1.

FIGS. 1–9 illustrate an arrowrest according to one preferred embodiment of this invention. As shown in FIGS. 1 and 2, the arrowrest comprises housing 311 which has housing wall 312 and which defines groove 313. Bushing 315 is either secured to or mounted within housing 311. As shown in FIG. 1., bushing 315 has an upper shoulder and is molded into the preferably plastic material of housing 311. However, it is apparent that bushing 315 can be secured or otherwise mounted with respect to housing 311 in any other suitable manner. Bushing 315 has through bore 316.

Figure 5:
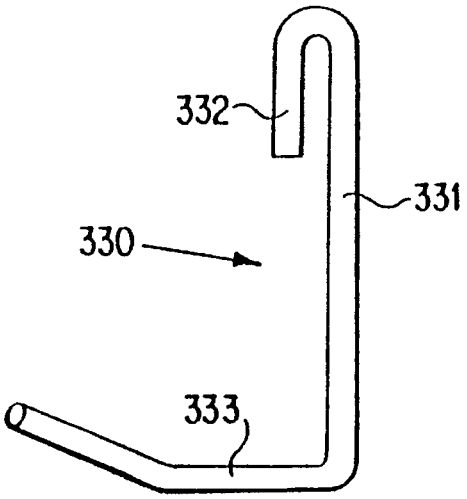
FIG. 5 is a front view of an arrow support arm, according to one preferred embodiment of this invention.
Figure 7:
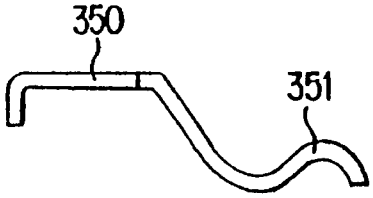
FIG. 7 is a top view of the spring clip, as shown in FIG. 6.
Figure 6:
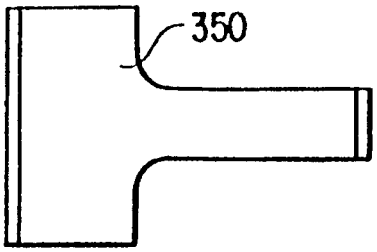
FIG. 6 is a front view of a spring clip, according to one preferred embodiment of this invention.
Figure 8:
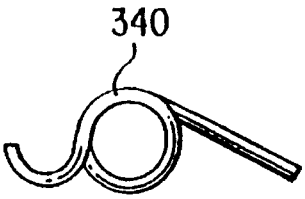
FIG. 8 is a front view of a return coil spring, according to one preferred embodiment of this invention.
Figure 9:
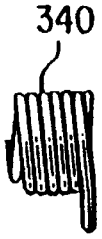
FIG. 9 is a side view of the return coil spring, as shown in FIG. 8.

As shown in FIG. 5, arrow support arm 330 has riser portion 331 and support portion 333. According to one preferred embodiment of this invention, free end portion 332 of support portion 333 is bent or formed at an angle with respect to riser portion 331. As shown in the drawings and as later discussed in this specification, such bent free end portion 332 acts as a cam surface which contacts either housing wall 312 or spring clip 350 so that support portion 333 has limited normal movement between a rest position and a deflected position of arrow support arm 330.

Riser portion 331 is rotatably mounted with respect to housing 311. In one preferred embodiment according to this invention, riser portion 331 is mounted within the through bore 316 of bushing 315. Riser portion 331 preferably has limited vertical movement when mounted within bushing 315. Such limited vertical movement can be accomplished by a combination of the bent free end portion 332 contacting housing 311 and a lower bend in the wire of arrow support arm 330, as shown in FIG. 1. It is apparent that such limited vertical movement can be accomplished with specific shoulder arrangements or by any other suitable vertical movement limiting means apparent to those persons skilled in the art.

Return spring 340 is mounted with respect to arrow support arm 330 so that it urges or biases support portion 333 into the normal rest position of arrow support arm 330. In such rest position, an arrow shaft is loaded onto support portion 333 of the arrowrest. According to one preferred embodiment of this invention, return spring 340 is a coil spring mounted around riser portion 331, as shown in FIGS. 1 and 2. When shaped as a coil, return spring 340 comprises two opposing spring feet. One spring foot is attached to free end portion 332 while the opposite spring foot abuts housing wall 312, according to the preferred embodiment as shown in FIGS. 1 and 2. It is apparent that the spring feet can be attached to other suitable elements of this invention and, thus, accomplish the same result of urging support portion 333 into the rest position of arrow support arm 330. Thus, when an arrow is discharged and passes in a forward axial direction, support portion 333 moves in a forward direction from the rest position to the deflected position. After the forces from the discharged arrow are relieved, return spring 340 urges support portion 333 back into the rest position.

Referring now to one particularly important aspect of this invention, the arrowrest further comprises release means for allowing support portion 333 to deflect in a backward direction, with respect to the above described forward direction, beyond the rest position of the normal movement. After forced backward beyond the rest position of arrow support arm 330, such release means also allows the support portion to be reset back to its rest position. Such particular aspect of this invention is important, for example, when carrying an archery bow and arrow support arm 330 accidentally catches an obstruction, such as a tree limb or any other field obstruction. With the backward deflecting aspect of this invention, in such situation, arrow support arm 330 will deflect backward without bending or otherwise damaging any portion of arrow support arm 330. When arrow support arm 330 moves in a backward direction beyond its rest position, it can be reset by simply moving arrow support 330 in a forward direction with enough force to overcome a resisting bias force applied by spring clip 350.

According to one preferred embodiment, the backward deflecting aspect of this invention is accomplished with spring clip 350 being secured or otherwise mounted with respect to housing 311. As shown in FIG. 2, spring clip 350 forms detent portion 351. Bent free end portion 332 acts as a cam surface with respect to detent portion 351. As riser portion 331 rotates within through bore 316 of bushing 315, free end portion 332 contacts detent portion 351. Continued rotation of riser portion 331 urges spring clip 350 into a deflected position so that riser portion 331 can continue to rotate backward allowing support portion 333 to move beyond the rest position. It is apparent that spring clip 350 can have any other suitable shape. Depending upon the particular arrangement of spring clip 350, it is apparent that spring clip 350 can be replaced by other spring means.

Spring clip 350 is preferably secured to or otherwise mounted with respect to housing 311 by a forced fitting of spring clip 350 within groove 313. However, it is apparent that spring clip 350 can be secured with respect to or mounted within housing 311 in any other suitable manner. However spring clip 350 is secured, it is important to note that in a rest position of arrow support arm 330, detent portion 351 should remain fixed with respect to housing 311.

Figure 3:
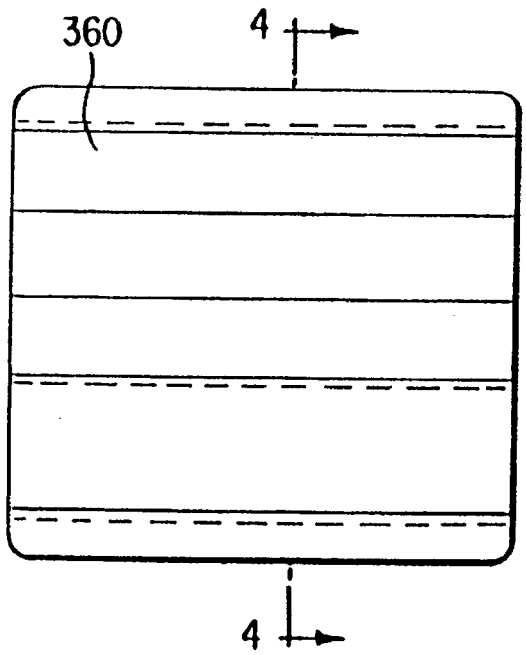
FIG. 3 is a front view of a cover according to one preferred embodiment of this invention.
Figure 4:
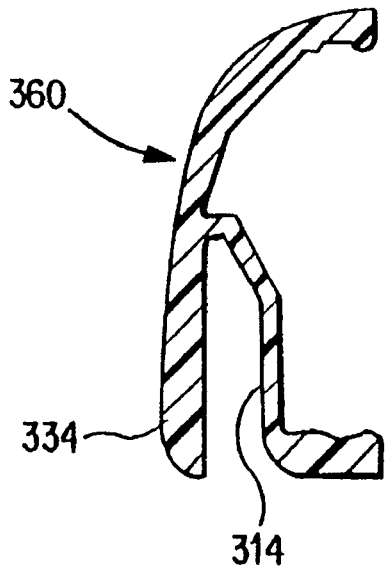
FIG. 4 is a cross-sectional view taken along line 4—4, as shown in FIG. 3.

In another preferred embodiment according to this invention, it is advantageous to enclose the above described elements which allow arrow support arm 330 to deflect both in a forward and backward direction. FIGS. 3 and 4 show one preferred embodiment of cover 360 which can be secured to housing 311 in any suitable manner known to those persons skilled in the art. Cover 360 preferably comprises horizontal cushion means for allowing a discharged arrow to force contact portion 334 of cover 360 in a horizontal direction, with respect to a vertically positioned archery bow. In one preferred embodiment according to this invention, the horizontal cushion means comprises contact portion 334 spaced at a distance from outer wall 314 of housing 311. Such cantilever arrangement allows contact portion 334 to deflect when horizontal component forces act upon contact portion 334, from the discharged arrow. With cover 360 injection molded to form an integral piece with housing 311, the resiliency of the integral piece urges or biases contact portion 334 into a normal shooting or rest position. Thus, after contact portion 334 is deflected, it is urged back into the normal shooting or rest position. However, it is apparent that contact portion 334 can also form a hinge connection with respect to housing 311 by other suitable mechanical means familiar to those persons skilled in the art.

U.S. Pat. Nos. 4,548,188, 4,732,135, 4,809,670, 4,881,515, and 5,148,796 more fully teach embodiments of the invention shown in FIGS. 11–18. These patents in their entirety are incorporated herein by reference. In these embodiments, the arrow support means may have a conventional retractable arrow support wire 90 rotatably mounted on or secured to flat plate 91. These patents teach flat plate 91 of the arrowrest removably, rigidly attached to one side of mating mounting plate 80. The other side of mating mounting plate 80 has fitting means 81 which snugly fits over the end of mounting means 20 and may be maintained firmly in position by a screw into the end of mounting means 20. It is apparent that fitting means 81 can have a "D" cross-sectional shape, as shown in FIG. 11, a double "D" cross-sectional shape as shown in FIG. 12, or any other cross-sectional shape that prevents rotation of mounting plate 80 with respect to handle-riser portion 10.

Figure 10:
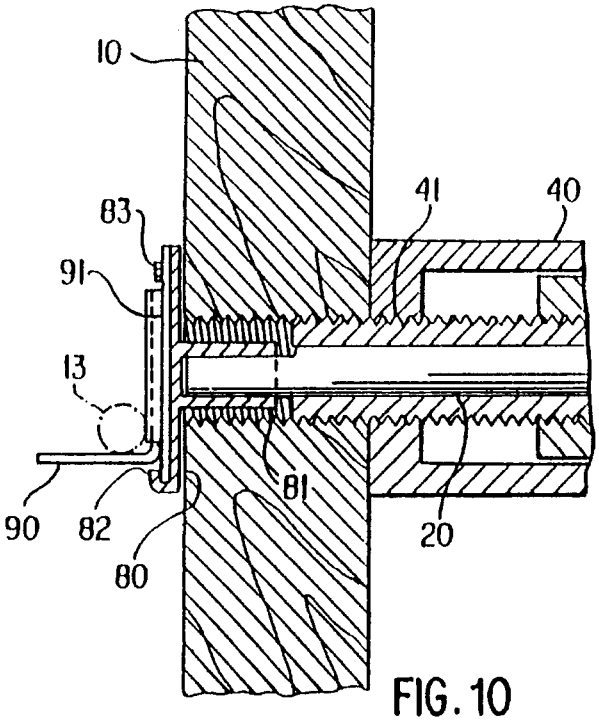
FIG. 10 is a partial cross-sectional view showing one embodiment of a mounted arrowrest according to this invention.
Figure 11:
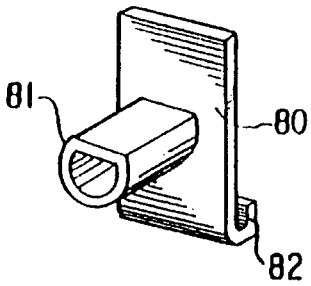
FIG. 11 is a perspective rear view of fitting means shown in FIG. 10.
Figure 12:
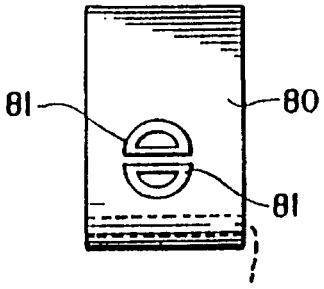
FIG. 12 is a rear view of another embodiment of the fitting means.
Figure 13:
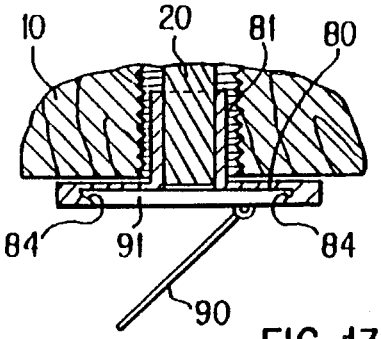
FIG. 13 is a top cross-sectional view of another embodiment of an arrowrest according to this invention.
Figure 14:
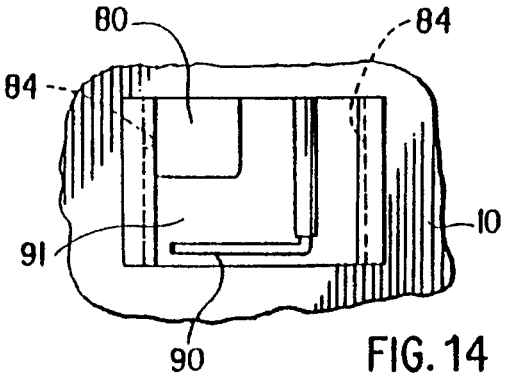
FIG. 14 is a front view of the arrowrest shown in FIG. 13.

The above-referenced patents teach a suitable mating mounting plate as shown in FIGS. 11 and 12 wherein mounting plate 80 has lip holding means 82 along the bottom edge and undercut holding means 83, as shown in FIG. 10, extending through elongated holes in flat plate 91 to hold it firmly in position. Thus, the retractable arrowrest may be readily replaced and assuredly positioned in the same position on mating mounting plate 80. Any suitable means for holding the retractable arrowrest to mounting plate 80 may be used. Another means for holding flat plate 91 is shown in FIGS. 13 and 14 wherein opposing sides have undercut edges 84 which mate with opposing sides of flat plate 91. Having a removable flat plate 91 as well as the connection between fitting means 81 and mounting means 20 provides an arrowrest having double instantly replaceable capabilities so that the arrowrest can be replaced either way.

Figure 15:
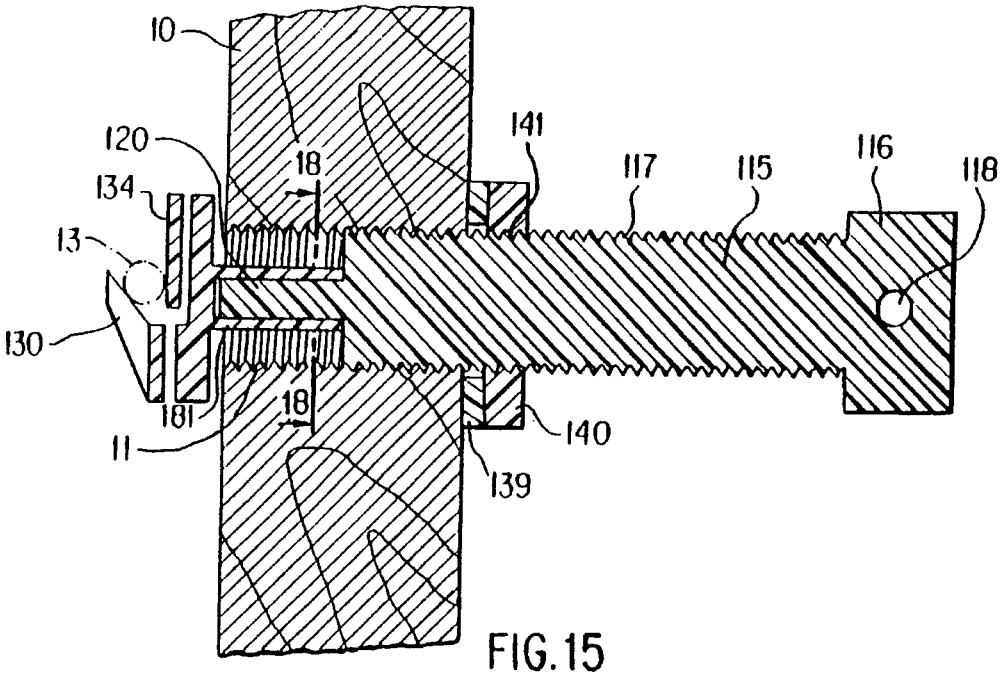
FIG. 15 is a cross-sectional view taken through a bow handle, from the side of an archer, showing one embodiment of a mounted arrowrest of this invention.

FIG. 15 shows one embodiment of a laterally adjustable one-piece arrowrest, having a movable arrow support arm 130 which deflects and automatically returns to an initial predetermined position. Adjusting screw 115 is installed within through opening 11 in handle-riser portion 10 of an archery bow. Adjusting screw 115 is secured and maintained in fixed relation to the bow by adjusting screw external threads 117 engaging internal threads of through opening 11. Adjusting screw 115 can be inserted into through opening 11 from either the arrow side or side opposite the arrow side of bow handle-riser portion 10. Adjusting screw 115 may be firmly held in a fixed lateral position by washer 139 and lock nut 140. Lock nut 140 can have internal threads 141 which engage adjusting screw external threads 117 and can be screwed tightly against one side of washer 139. The opposite side of washer 139 can be adjacent either side of bow handle-riser portion 10 of an archery bow.

Adjusting screw 115 has adjusting screw end 116 positioned away from bow handle-riser portion 10. Adjusting screw end 116 can have an outside diameter greater than the outside diameter of adjusting screw 115. However, adjusting screw 115 has the capability of being inserted from either side of bow handle-riser portion 10 only if adjusting screw end 116 has an outside diameter less than or equal to the inside diameter of the internal threads of through opening 11. Adjusting screw end 116 has diametrical through hole 118 into which a rod is inserted for at least two purposes. First, the rod can be used as a lever arm to torque adjusting screw 115 into through opening 11. Second, through hole 118 aligns with first connecting means 120 so that through hole 118 or the rod inserted within through hole 118 can be used as an index for the alignment of first connecting means 120.

Rotating adjustment screw 115 causes lateral movement of adjusting screw 115. The exterior surface of lock nut 140 may have flats for engaging a wrench or may have knurls and a diameter sufficiently sized for hand tightening. The knurls allow quick assembly and disassembly in the field, without a need for tools. When lock nut 140 is rotated tightly against washer 139 and washer 139 against bow handle-riser portion 10, both adjusting screw 115 and lock nut 140 are firmly attached in a fixed position with respect to the bow. It is preferred that threads 117 of adjustment screw 115 extend approximately halfway through the thickness of bow handle-riser portion 10 to provide sufficient support for adjustment screw 115 and to provide sufficient longitudinal bearing surface between first connecting means 120 and second connecting means 181.

In one embodiment of this invention, second connecting means 181 has an elongated shape and has a sleeve adapted to fit non-rotatably but longitudinally movable and to seat with first connecting means 120 of adjusting screw 115. The term "seat" or "seated" as used throughout this specification and in the claims, is intended to mean that the seated component is fixed in a particular position, with respect to another component. First connecting means 120 may have any suitable cross-sectional shape that nonrotatably mates with second connecting means 181. Various cross-sectional shapes for first connecting means 120 and mating second connecting means 181 may be used. First connecting means 120 according to this embodiment is shown more clearly in the cross-sectional view of FIG. 18. The non-circular cross-sectional shape of first connecting means 120 provides a non-rotatable and longitudinally movable fit and seat within second connecting means 181. First connecting means 120 may have other cross sections such as a truncated circular cross section or a splined shape cross section. It is readily apparent that other non-circular cross-sectional shapes would also be suitable.

Figure 39:
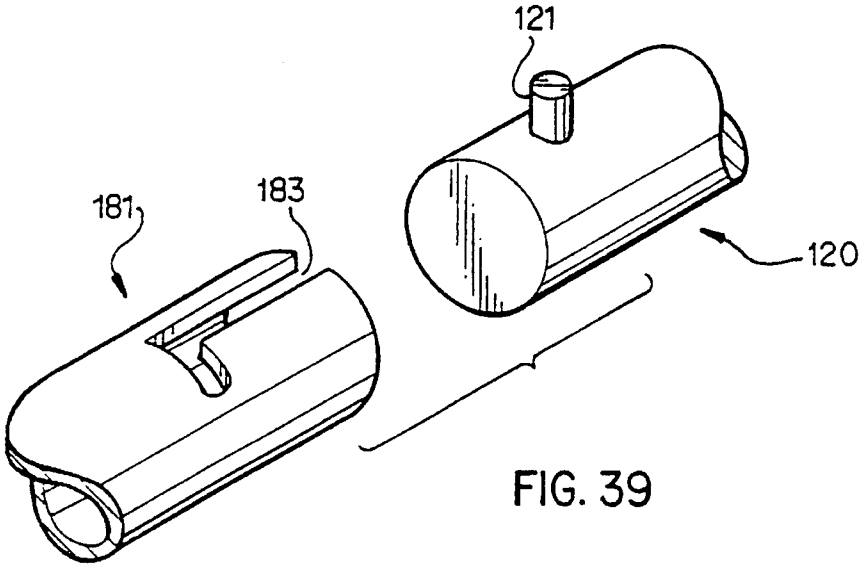
FIG. 39 is a perspective view of a connection between a male connector and a female connector, according to one preferred embodiment of this invention.

FIG. 39 shows still another preferred embodiment of this invention wherein first connecting means 120 comprise a rod, preferably cylindrical, with pin 121 mounted to the rod. Second connecting means 181 may comprise slot 183 which has a longitudinal portion and a circumferential portion approximately perpendicular to the longitudinal portion. When second connecting means 181 is mated with first connecting means 120, pin 121 travels within slot 183 until it bottoms out at the end of the longitudinal portion of slot 183. Second connecting means 181 is then rotated with respect to first connecting means 120 and thereby locks pin 121 within slot 183. It is apparent that an interference fit can be used to form friction between the interlocking pin 121 and side walls of second connecting means 181 which forms slot 183 to thereby lock the relative position of first connecting means 120 with respect to second connecting means 181.

Figure 40:
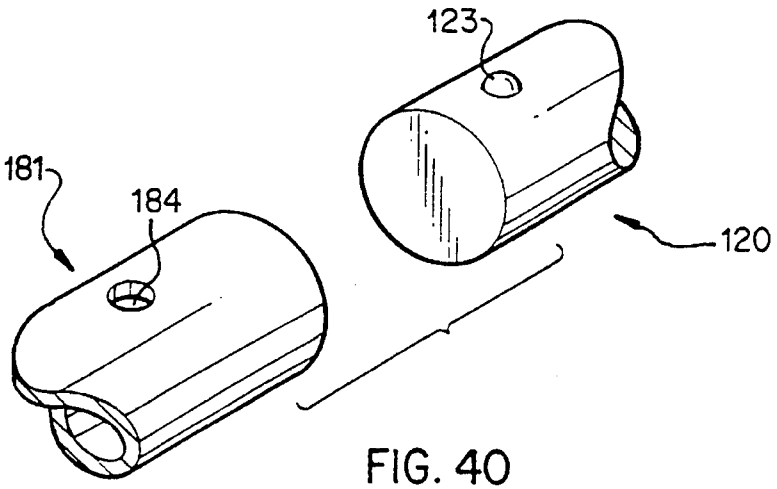
FIG. 40 is a perspective view of a connection between a male connector and a female connector, according to yet another preferred embodiment of this invention.

FIG. 40 shows another preferred embodiment wherein first connecting means 120 are secured in a fixed position with respect to second connecting means 181 by spring loaded sphere 123 which protrudes above a portion of the rod forming first connecting means 120. In lieu of slot 183 as shown in FIG. 39, second connecting means 181 may comprise through hole 184 which has an approximately circular cross-sectional shape. As first connecting means 120 is mated with second connecting means 181, spring loaded sphere 123 retracts within the rod of first connecting means 120. Spring loaded sphere 123 rides on the inner surface of second connecting means 181 until sphere 123 is positioned so that it can advance within through hole 184, due to the force of the spring loading.

FIGS. 39 and 40 show first connecting means 120 as the male connector and second connecting means 181 as the female connector. It is apparent that the roles of first connecting means 120 and second connecting means 181 can be reversed to accomplish the same result of interlocking first connecting means 120 with respect to second connecting means 181.

Figure 16:
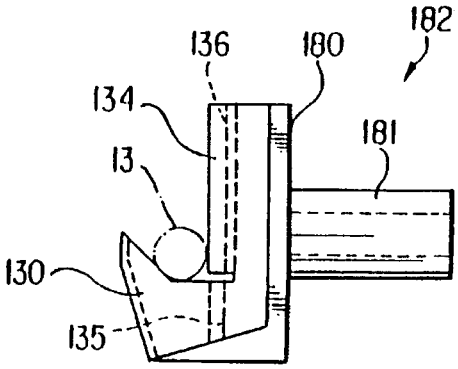
FIG. 16 is a rear view of the arrowrest as shown in FIG. 15.
Figure 17:
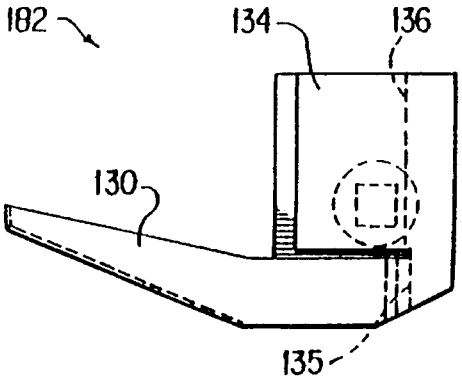
FIG. 17 is a side view of the arrowrest as shown in FIG. 15.
Figure 18:
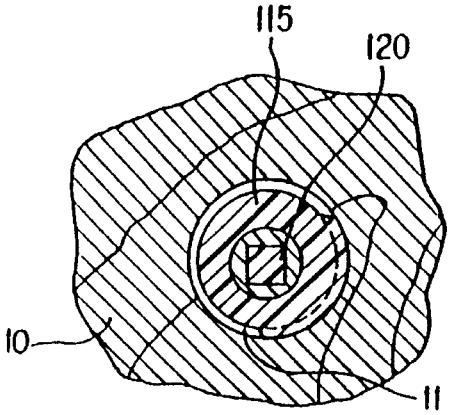
FIG. 18 is a cross-sectional view along line 18—18 in FIG. 15, showing one embodiment of first connecting means and second connecting means.

In addition to first connecting means 120 being adjustable longitudinally with respect to bow handle-riser portion 10, pressure from the arrow shaft applied laterally to arrowrest 182 may force arrow contact portion 134, as shown in FIGS. 15–17, inwardly thereby causing longitudinal movement of contact portion 134 by a resilient contact hinge which returns to its original predetermined position when the force of the arrow shaft is removed. The resilient contact hinge is formed by a section of contact portion 134 having a reduced moment of inertia, with respect to the moment of inertia of adjacent sections of contact portion 134, in order to reduce the bending resistance of contact portion 134. The grooved portion of the resilient hinge reduces the force necessary to deflect the cantilever portion of contact portion 134. The force necessary to move contact portion 134 can be adjusted by quickly and easily replacing one arrowrest 182 with another arrowrest 182 either having a different grooved portion forming a resilient contact hinge or having different construction material.

In one preferred embodiment according to this invention, first connecting means 120 are non-rotatably mated and seated with respect to second connecting means 181. In this particular embodiment, the term "seated" is intended to mean that first connecting means 120 is fixed in a mated position with second connecting means 181. The end, facing away from the arrow shaft, of second connecting means 181 can seat against the shoulder created where the base of first connecting means 120 meets adjusting screw 115. Second connecting means 181 can also seat with respect to first connecting means 120 if the end face of first connecting means 120 contacts the plate portion of second connecting means 181, or the seating can occur if the plate portion of second connecting means 181 contacts bow handle-riser portion 10. Even if first connecting means 120 does not seat on second connecting means 181, an interference fit with friction and compression between both connecting means will hold arrowrest 182 in a fixed position with respect to first connecting means 120.

Although one preferred embodiment of this invention has two mating pieces with first connecting means 120 having the male fitting and second connecting means 181 having the female fitting, it is apparent that another embodiment of this invention may have first connecting means 120 as the female fitting and second connecting means 181 as the male fitting.

Prior arrowrests secure to bow handle-riser portion 10 with adhesives, screws, or the like, which require complete realignment once removed. In addition, except for the stick-on type, which uses double-sided tape, prior arrowrests require tools for assembly and disassembly. The non-rotatable and seating connection of this invention provides quick and easy field assembly and disassembly without a need for tools while maintaining the precise position and alignment of the arrowrest.

One important embodiment of this invention includes a pivotal arrow support arm 130 as an integral one-piece part of arrowrest 182 whereby arrow support arm 130 deflects upon an arrow shaft and fletching passing over arrow support arm 130. A grooved portion forming resilient arm hinge 135 near the base of arrow support arm 130 causes automatic return of arrow support arm 130 to its initial predetermined position after discharge of an arrow. Arrow support arm 130 extends beyond the side of the bow handle-riser portion 10 and receives arrow shaft 13, as shown in FIG. 16.

When the force of the arrow passing over arrow support arm 130 is terminated, the grooved portion forming resilient arm hinge 135 at the base of arrow support arm 130 creates a force sufficient to return arrow support arm 130 to its original predetermined position. The resilient arm hinge is formed by a section of arrow support arm 130 having a reduced moment of inertia, with respect to the moment of inertia of adjacent sections of arrow support arm 130, in order to reduce the bending resistance of arrow support arm 130. The grooved portion of the resilient hinge reduces the force necessary to deflect the cantilever portion of arrow support arm 130. Likewise, the lateral force of the arrow shaft can cause contact portion 134 to move laterally toward the bow and when the force of the arrow passing over contact portion 134 is terminated, the grooved portion forming resilient contact hinge 136 near the base of contact portion 134 creates a force sufficient to return contact portion 134 to its original predetermined position. The force, within the resilient hinges of this invention, opposing the force created by the moving arrow shaft may be controlled by varying the grooved portion or by varying the construction material used for arrowrest 182. The top of arrow support arm 130 and contact portion 134 may be covered with a low friction material that reduces the frictional drag between arrow shaft 13 and support arm 130. Suitable low friction materials include low friction plastics, such as fluorinated hydrocarbons, TEFLON™, or any other low friction materials known to those persons skilled in the art.

This invention provides an improved arrowrest as shown in FIGS. 15–18, where arrow support arm 130, contact portion 134, mounting plate 182 and second connecting means 181 are formed from one piece. With an interference fit, second connecting means 181 and first connecting means 120 can be quickly and easily assembled, disassembled, and reassembled without a need for tools. The non-rotatable and seated mating of second connecting means 181 with first connecting means 120 allows arrowrest 182 to be precisely positioned and aligned with respect to bow handle-riser portion 10. Adjusting screw 115 and holding nut 140 allow lateral positioning and securing of arrowrest 182 with respect to bow handle-riser portion 10.

The components of the arrowrest of this invention may be constructed of suitable materials which are durable and resist weather. Suitable metals and moldable plastics will be readily apparent to one skilled in the art.

The quick disconnect means is one important aspect of this invention which allows the arrowrest to be dismounted then instantly replaced in a precise and consistent predetermined position. The quick disconnect means includes first connecting means 120 fixed with respect to handle-riser portion 10 of an archery bow and second connecting means 181 secured to the arrowrest.

Figure 19:
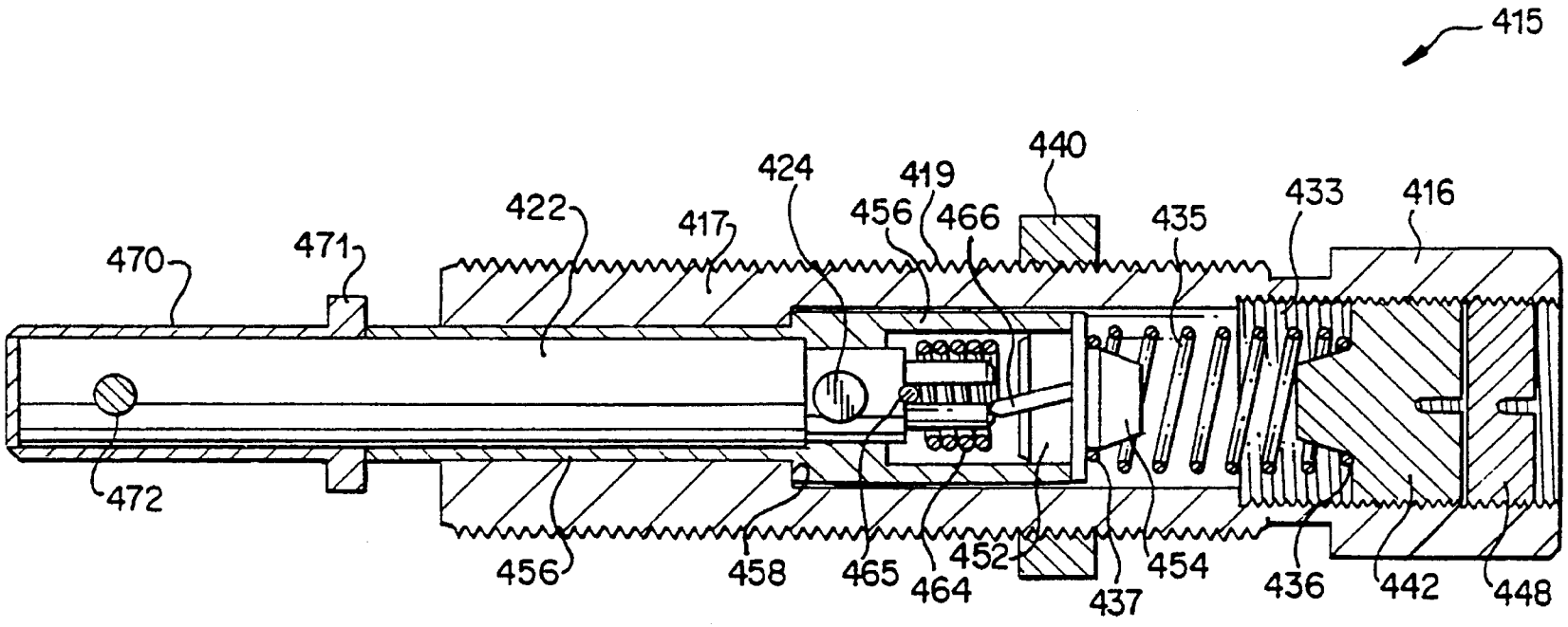
FIG. 19 is a partial cross-sectional view of an assembled mounting apparatus having returnable pivoting action and returnable plunger action, according to one preferred embodiment of this invention.
Figure 22:
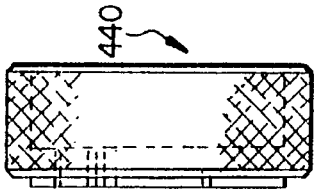
FIG. 22 is a side view of a knurled lock nut, according to one preferred embodiment of this invention.
Figure 45:
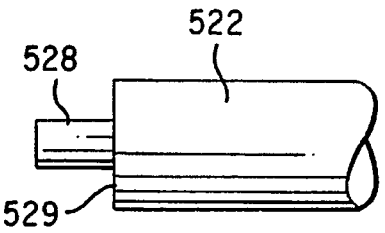
FIG. 45 is a front view of a tip portion of a supporting rod, according to one preferred embodiment of this invention.

FIGS. 19–45 show various technical aspects of mounting apparatus 415 and 515, according to other various preferred embodiments of this invention. It is apparent that mounting apparatus 415 or 515 can be used in lieu of and in the same manner as the previously described adjusting screw 115. As shown in FIGS. 19, 22 and 44, lock nut 440, 540 can be used to fix the linear position of mounting apparatus 415, 515 within through opening 11 of handle-riser portion 10 of an archery bow, as shown in FIGS. 15 and 45.

Figure 43:
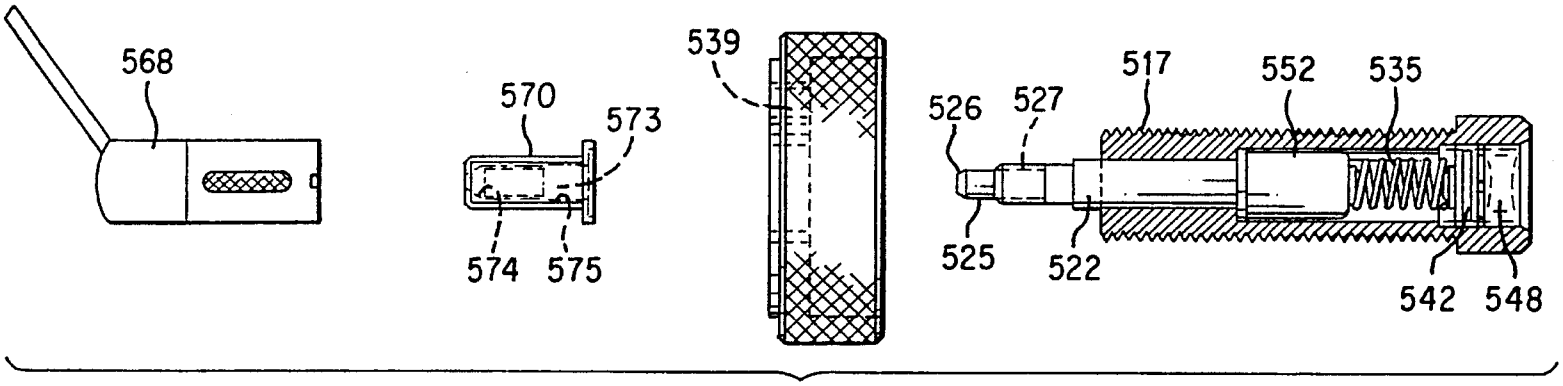
FIG. 43 is an exploded partial cross-sectional view of a mounting apparatus, a lock nut, an end cap and an arrowrest assembly, according to another preferred embodiment of this invention.
Figure 44:
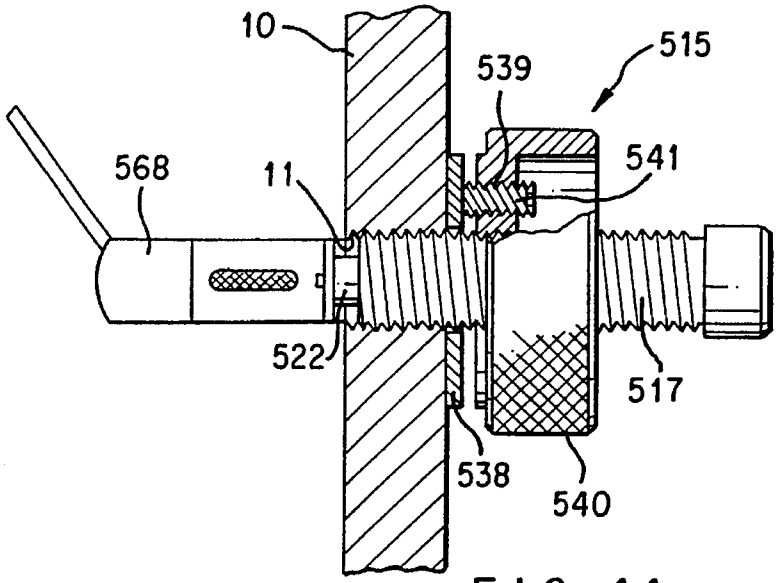
FIG. 44 is a partial cross-sectional view showing the mounting apparatus, the lock nut, the end cap and the arrowrest shown in FIG. 43, mounted to an archery bow riser portion.

As shown in FIGS. 22, 43 and 44, lock nut 440, 540 has a through bore 539, as shown in FIGS. 43 and 44. Set screw 541 is mateably engageable within bore 539. As shown in FIG. 44, a longitudinal axis of set screw 541 is positioned approximately parallel to a longitudinal axis of housing 517, so that set screw 541 can be rotated against either handle-riser portion 10 of an archery bow or against washer 538, which can be positioned between handle-riser portion 10 and lock nut 540, as shown in FIG. 44.

The improved set screw 541 arrangement according to this invention does not abut the external threads of the housing, as do other conventional lock nut arrangements which have a set screw directed along a radial axis of the lock nut. Such conventional arrangements vibrate loose during use of the bow and also damage the external threads of the screw against which the set screw abuts.

Figure 20:
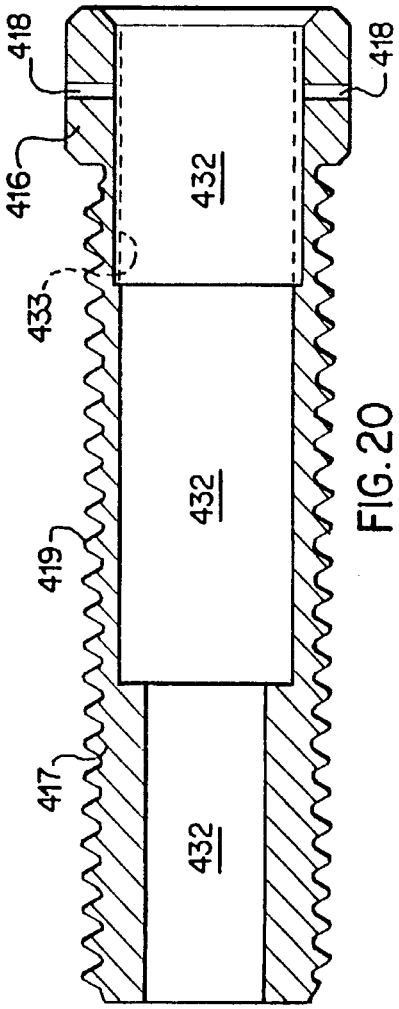
FIG. 20 is a cross-sectional view of a housing, according to one preferred embodiment of this invention.

According to one preferred embodiment of this invention as shown in FIG. 19, mounting apparatus 415 comprises end cap 470 attached to an end portion of rod 22, wherein end cap 470 has returnable pivoting action and returnable plunger action, with respect to housing 417. As shown in FIG. 20, housing 417 has longitudinal bore 432 which as shown in FIG. 20 is preferably a through bore extending along a longitudinal axis of housing 417. However, it is apparent that a bore having one closed end can also be used to accomplish the same results of this invention. The complete through bore of longitudinal bore 432 as shown in FIG. 20 enhances the assembly and disassembly of the internal components within housing 417 and the variable bias force of compression spring 435 through the use of tension screw 442, as discussed later in this specification.

Figure 24:
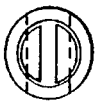
FIG. 24 is an end view of the rod as shown in FIG. 23, looking in a direction from right to left as shown in FIG. 23.
Figure 23:
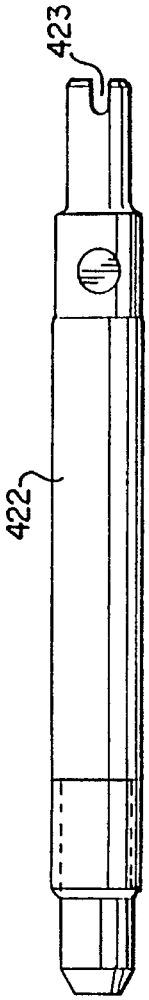
FIG. 23 is a front view of the rod which pivots and rotates with respect to the housing, according to one preferred embodiment of this invention.
Figure 25:
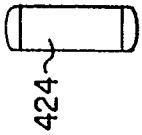
FIG. 25 is a front view of a stop pin, according to one preferred embodiment of this invention.

Rod 422, as shown in FIGS. 19, 23 and 24, is slidably mounted within longitudinal bore 432, as shown in FIG. 19. It is apparent that rod 422 slides with respect to housing 417 and that such relative mounting can be accomplished with suitable designs of rod 422 other than those shown in FIGS. 19, 23 and 24.

Plunger means are used to return rod 422 to a linear rest position after linear displacement of rod 422 with respect to housing 417. Linear displacement of rod 422 occurs, for example, when an arrow is discharged from the arrowrest which is mounted to end cap 470. As discussed throughout this specification, first connecting means 120 or second connecting means 181 may comprise a connector such as end cap 470. It is apparent that any suitable arrowrest can be used with mounting apparatus 415 according to this invention. Thus, when mounting apparatus 415 is mounted within an archery bow, for example, end cap 470 will rotate and move in a linear direction, both with respect to the archery bow.

As shown in FIG. 20, housing 417 has external threads 419 which can be engaged with the standard internal threads within a bow handle of an archery bow. Such standards are set by the Archery Manufacturers Organization (AMO). It is apparent that in lieu of external threads 419, other means, such as compression fits, interference fits, and the like for fixing housing 417 with respect to an archery bow or another apparatus are known to those skilled in the art.

Figure 28:
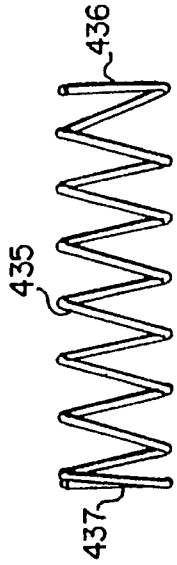
FIG. 28 is a front view of a compression spring, according to one preferred embodiment of this invention.
Figure 41:
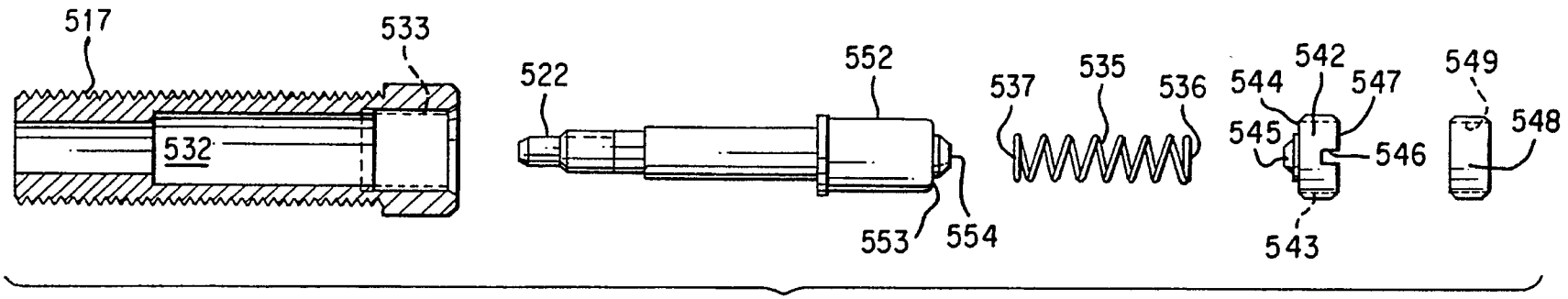
FIG. 41 is an exploded partial cross-sectional view of components which form a plunger assembly, according to one preferred embodiment of this invention.
Figure 42:
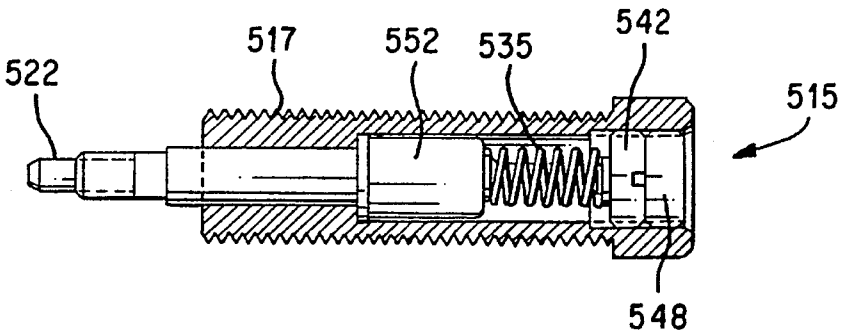
FIG. 42 is a partial cross-sectional view of the plunger assembly as shown in FIG. 41, in an assembled condition.

In one preferred embodiment according to this invention, the plunger means comprise compression spring 435, 535 mounted within longitudinal bore 432, 532, as shown in FIGS. 19 and 42, wherein compression spring 435, 535, as shown in FIGS. 28 and 41, has one spring end 436, 536 fixed with respect to rod 422, 522 and an opposite spring end 437, 537 fixed with respect to housing 417, 517. As shown in FIGS. 19 and 42, tension screw 442, 542 can be used to adjust the bias force of compression spring 435, 535. As shown in FIGS. 29, 30 and 41–44, tension screw 442, 542 has external threads 443, 543, according to preferred embodiments of this invention. As shown in FIGS. 19 and 42, external threads 443, 543 engage with internal threads 433, 533 within longitudinal bore 432, 532. Preferably, at least a portion of longitudinal bore 432, 532 has internal threads 433, 533. Tension adjustment screw 442, 542 can thus be rotated and moved along a longitudinal axis of housing 417, 517 to vary the length of compression spring 435, 535 and thereby either increase or decrease the bias force within compression spring 435, 535.

Figure 29:
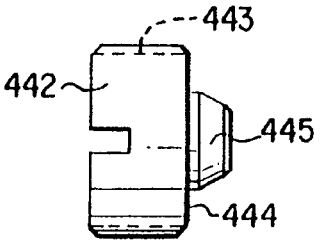
FIG. 29 is a front view of a tension screw, according to one preferred embodiment of this invention.
Figure 30:
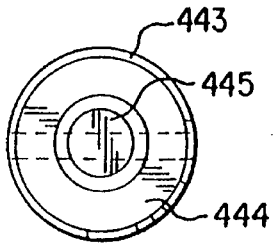
FIG. 30 is a side view of the tension screw as shown in FIG. 29, looking in a direction from right to left as shown in FIG. 29.
Figure 31:
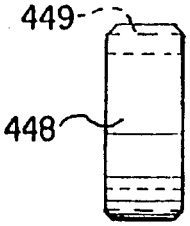
FIG. 31 is a front view of a lock screw, according to one preferred embodiment of this invention.

As shown in FIGS. 19, 29 and 41, tension adjustment screw 442, 542 preferably comprises retaining pin 445, 545 which is secured to face 444, 544 of tension adjustment screw 442, 542. As shown in FIGS. 19 and 42, the end portion of compression spring 435, 535 which has spring end 436, 536 is mounted about retaining pin 445, 545.

As shown in FIGS. 19, 31, 32, 42 and 43, lock screw 448, 548 can be used to lock the relative position of tension adjustment screw 442,542 with respect to housing 417, 517. Lock screw 448, 548 preferably has external threads 449, 549 which also engage with internal threads 433,533 of longitudinal bore 432, 532.

Figure 32:
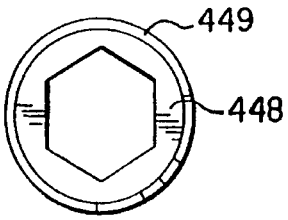
FIG. 32 is a side view of the lock screw as shown in FIG. 31, looking in a direction from right to left as shown in FIG. 31.

As clearly shown in FIGS. 31, 32 and 41–43, lock screw 448, 548 has a non-circular through bore. As shown in FIG. 32, the through bore has a generally hexagonal shape, which is particularly suitable for engagement with an Allen wrench. It is apparent that other non-circular through bores can be used to accomplish the same result. As clearly shown in FIG. 43, it is apparent that the through bore within lock screw 548 forms access means for accessing tension adjustment screw 542, even while external threads 549 of lock screw 548 are engaged with internal threads 533 of longitudinal bore 532. Such preferred embodiment of this invention enables quick and easy adjustment of compression spring 535 with a very simple tool, such as an elongated tool having a standard screwdriver end and an Allen wrench end.

In a locked position of the arrangement of tension adjustment screw 542 and lock screw 548, lock screw 548 abuts tension adjustment screw 542. Tension adjustment screw 542 preferably has slot 546 in head surface 547 of tension adjustment screw 542.

Figure 36:
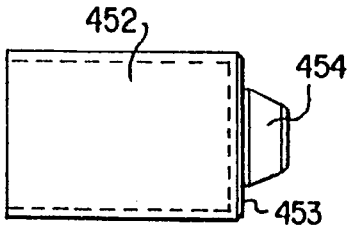
FIG. 36 is a front view of an end cap, according to one preferred embodiment of this invention.

Compression spring 435, 535 is also retained in its position with spring end cap 452, 552, as shown in FIGS. 19, 36 and 42. Retaining pin 454, 554 is secured to face 453, 553 of spring end cap 452, 552. An end portion of compression spring 435, 535 having spring end 437, 537 is mounted about retaining pin 454, 554. It is apparent that other means for retaining compression spring 435, 535 within longitudinal bore 432, 532 can be used to accomplish the same result of exerting a bias force upon rod 422, 522.

Figure 34:
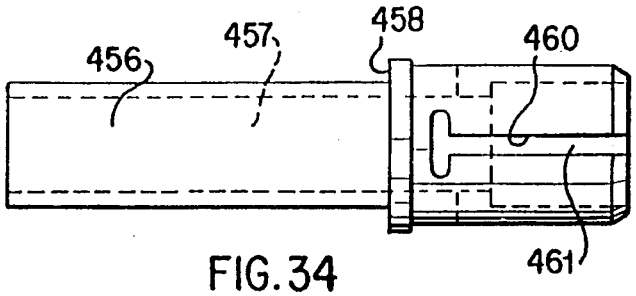
FIG. 34 is a top view of the plunger shaft shown in FIG. 33.
Figure 35:
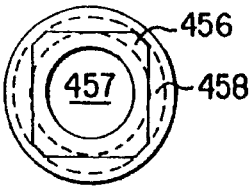
FIG. 35 is a side view of the plunger shaft as shown in FIG. 33, looking in a direction from left to right as shown in FIG. 33.
Figure 33:
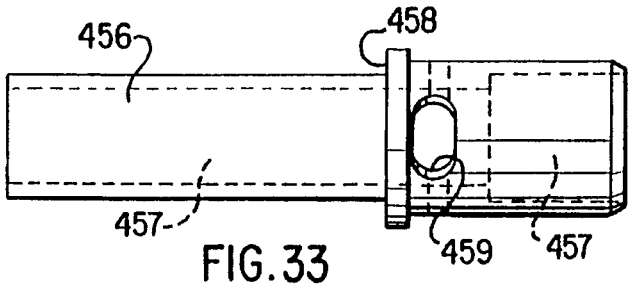
FIG. 33 is a front view of a plunger shaft, according to one preferred embodiment of this invention.

FIGS. 33–35 show one preferred embodiment of plunger shaft 456 which has longitudinal through bore 457. As shown in FIG. 19, rod 422 is slidably mounted within longitudinal through bore 457. Because rod 422 is mounted within longitudinal through bore 457, rod 422 is also referred to as mounted within longitudinal bore 432. An external surface of plunger shaft 456 has or forms shoulder 458 which abuts housing 417. Such abutting relationship between plunger shaft 456 and housing 417 results in a limiting position for the axial movement of rod 422 with respect to housing 417. When plunger shaft 456 abuts housing 417, rod 422 is in its linear rest position.

Figure 37:
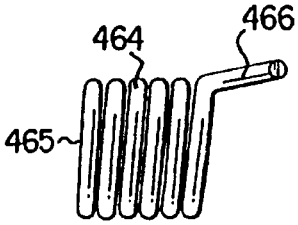
FIG. 37 is a front view of a torsion spring, according to one preferred embodiment of this invention.
Figure 38:
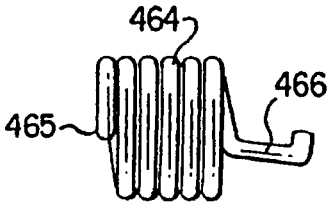
FIG. 38 is a front view of a torsion spring, according to another preferred embodiment of this invention.

This invention may also comprise pivot means for rotating rod 422 about a longitudinal axis of rod 422, and for returning rod 422 to its rotational rest position after rotational displacement of rod 422 with respect to housing 417. In one preferred embodiment according to this invention, the pivot means comprise rod 422 being rotatably mounted within longitudinal bore 457. Bias means are used to return rod 422 to its rotational rest position after the rotational displacement of rod 422. In one preferred embodiment according to this invention, the bias means comprise torsion spring 464, as shown in FIGS. 19, 37 and 38, having spring foot 465 secured with respect to rod 422. The opposite spring foot 466 is preferably mounted within mounting bore 461 of side wall 460 of plunger shaft 456.

Plunger shaft 456 preferably has rotation slot 459 extending about at least a portion of the circumference of plunger shaft 456. Rotation pin 424 is secured to rod 422 and mounted within rotation slot 459, as shown in FIG. 33. When rod 422 is in a limiting rotational position with respect to plunger shaft 456, rotation pin 424 abuts plunger shaft 456 or bottoms-out within rotation slot 459.

Figure 26:
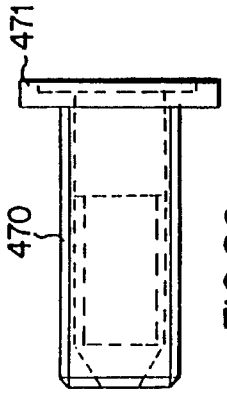
FIG. 26 is a front view of an end cap which is mounted on an end portion of the rod, according to one preferred embodiment of this invention.
Figure 21:
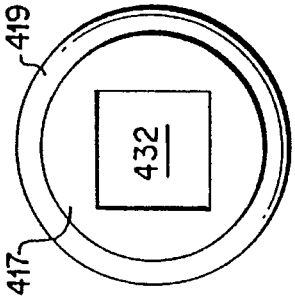
FIG. 21 is an end view of the housing as shown in FIG. 20, looking in a direction from left to right as shown in FIG. 20.
Figure 27:
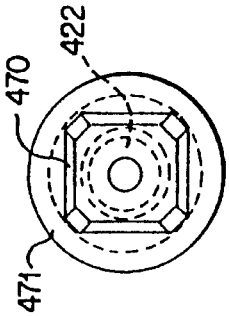
FIG. 27 is a side view of the end cap as shown in FIG. 26, looking in a direction from left to right as shown in FIG. 26.

As shown in FIGS. 19, 26, 27 and 43, mounting apparatus 415, 515 further comprises end cap 470, 570 which is mounted on an end portion of rod 422, 522. Such end portion preferably extends outward from housing 417, 517. Depending upon the particular method of connection, it is also apparent that the portion of rod 422, 522 to which end cap 470, 570 is attached need not be external with respect to longitudinal bore 432, 532. As shown in FIGS. 26, 27 and 43, end cap 470, 570 basically comprises a female fitting and it is apparent that the roles between the male connector of the end portion of rod 422, 522 and the female connector of end cap 470, 570 can be reversed without departing from the intent of this invention, while still achieving the same desired result.

As shown in FIGS. 26 and 27, end cap 470 is attached to rod 422 by a threaded connection. However, it is apparent that any other suitable connection means, such as an interference-fitted pin 472 mounted through end cap 470 and rod 422 as shown in FIG. 19, would accomplish the same result of attaching end cap 470 with respect to rod 422.

As shown in FIG. 19, flange 471 is secured to end cap 470 at a distance from housing 417, as shown in FIG. 19, when rod 422 is in its linear rest position. Flange 471 stops rod 422 at its other extreme and limiting position. Flange 471 bottoms-out against housing 417 and thus prevents rod 422 from moving any further in a direction from left to right as shown in FIG. 19.

In the preferred embodiment of this invention shown in FIGS. 43–45, end cap 570 is attached to rod 522 in other preferred manners. As shown in FIG. 43, end cap 570 is fixedly attachable with archery utensil 568, which is shown in FIGS. 43 and 44 as an arrowrest. The preferred embodiments of the attachment between end cap 570 and rod 522 provide repositioning means for quickly engaging and disengaging end cap 570 from tip portion 525 of rod 522. In an attached position of end cap 570 with respect to rod 522, the fixed position of end cap 570 with respect to tip portion 525 remains constant.

In one preferred embodiment according to this invention, such repositioning means comprise end cap 570 having bore 573 and beveled surface 574. Beveled surface 574 is preferably positioned about a bottom area of bore 573. Tip portion 525 also has a beveled surface 526 which, in an attached position of end cap 570 with respect to rod 522, beveled surface 574 contacts beveled surface 526. Thus, it is possible to assemble and disassemble end cap 570 with respect to rod 522 while maintaining a constant, precise and fixed position of end cap 570 with respect to tip portion 525 and rod 522. Such constant, precise and fixed position is an important aspect of this invention which enables assembly and disassembly of an arrowrest without requiring realignment of archery sights and other calibrated positions of archery equipment.

In another preferred embodiment according to this invention, such repositioning means may also comprise end cap 570 having internal threads 575 about bore 573 and tip portion 525 having external threads 527, wherein external threads 527 engage with internal threads 575 to maintain the constant and precise position of end cap 570 with respect to rod 522. Depending upon the particular archer, it is apparent that internal threads 575 and external threads 527 can be either left-handed threads or right-handed threads, in order to prevent end cap 570 from working loose from vibration caused by a discharged arrow.

In still another preferred embodiment according to this invention, as shown in FIG. 45, the repositioning means comprise guide pin 528 either attached to, connected to, or integral with tip portion 525 of rod 522. Stop shoulder 529 is formed at the transition area between guide pin 528 and tip portion 525. In a mounted position of end cap 570 with respect to rod 522, end cap 570 abuts stop shoulder 529.

As previously discussed in the specification, first connecting means 120 and second connecting means 181 are used to attach an arrowrest or other similar device with respect to an archery bow or other similar structure. It is apparent that either rod 422 or end cap 470 can act as either first connecting means 120 or second connecting means 181, depending upon the particular role of the acting element.

Figure 46:
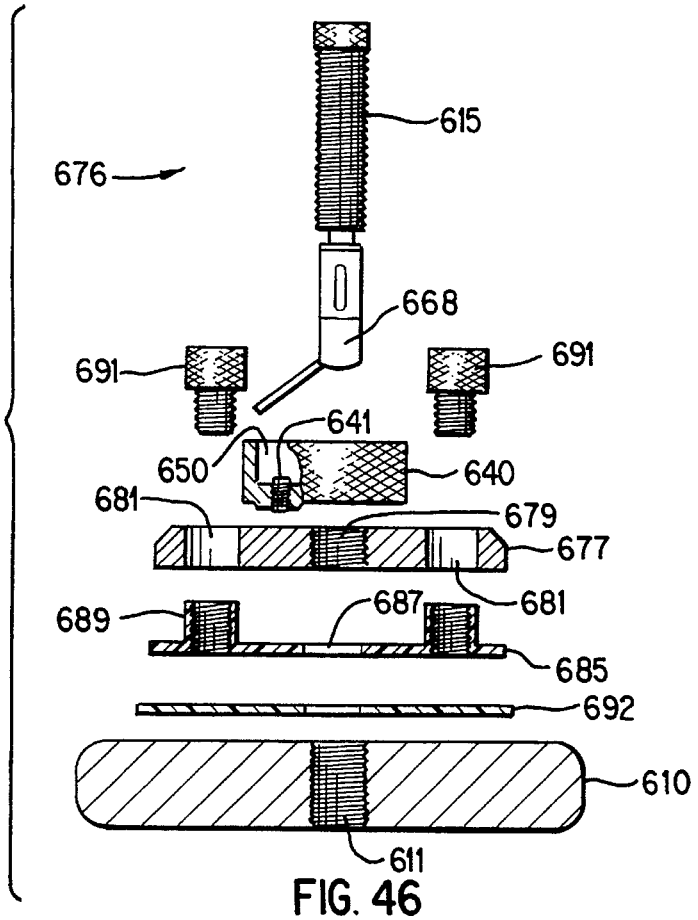
FIG. 46 is an exploded, partial cross-sectional top view of an archery accessory adapter, according to one preferred embodiment of this invention.

FIG. 46 shows an archery accessory adapter apparatus, according to one embodiment of this invention. Bow handle-riser portion 610 has opening 611 which is standard for conventional archery bows. Conventional archery accessories such as arrowrests and arrow plungers are often positioned within and extend through opening 611.

According to one preferred embodiment of this invention, a suitable adhesive, such as double-sided mounting tape 692, secures subplate 685. It is apparent subplate 685 can be secured to bow handle-riser portion 610 by other means, such as a screw, a clamp, or in a variety of other ways known to those skilled in the art. Subplate 685 forms subplate bore 687 which is preferably aligned with opening 611. Subplate bore 687 can be of various sizes and shapes, as long as mounting apparatus 615 can engage archery utensil 668 through subplate bore 687.

Figure 51:
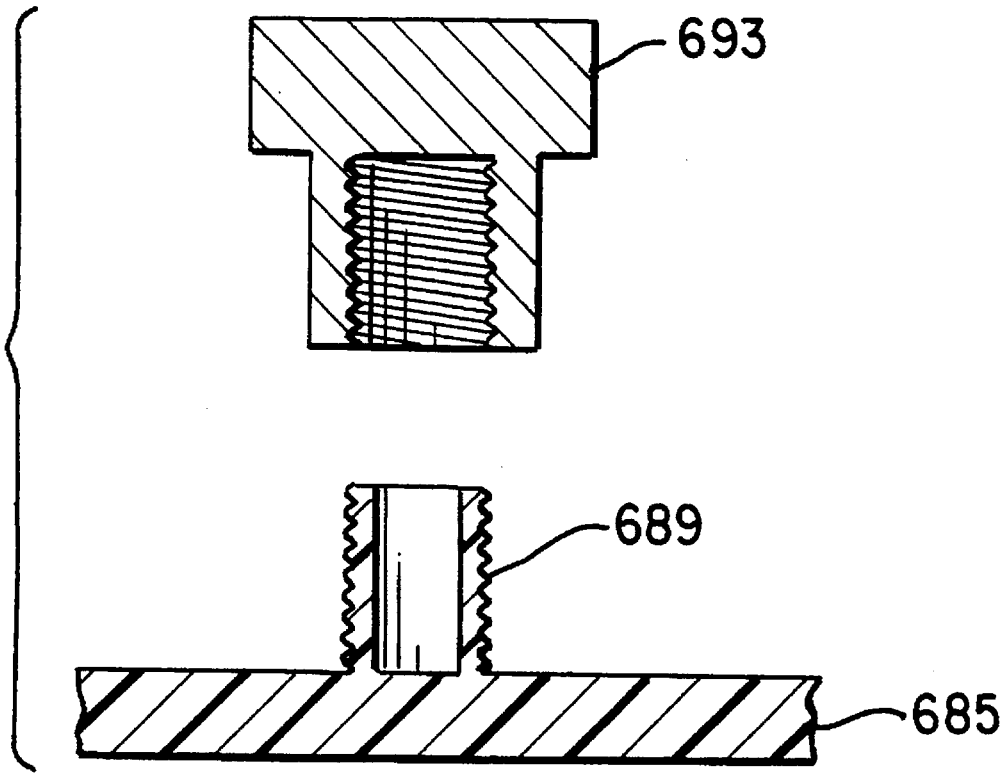
FIG. 51 is an exploded, cross-sectional view of a collar and a thumbscrew according to one preferred embodiment of this invention.

Adapter plate 677 has adapter bore 679 which is preferably aligned with opening 611 and subplate bore 687 for receiving mounting apparatus 615. Adapter plate 677 is detachably secured to subplate 685. According to a preferred embodiment of this invention, subplate 685 has one or more collars 689, preferably two as shown in FIG. 46, and adapter plate 677 has corresponding mating bores 681 that receive internally threaded collars 689. As shown in FIG. 46, externally threaded thumbscrews 691 can threadedly engage internally threaded collars 689, and fix adapter plate 677 to subplate 685. According to another preferred embodiment of this invention, externally threaded collars 689 can extend beyond the surface of adapter plate 677 and threadedly engage cap screws 693, as shown in FIG. 51. According to yet another preferred embodiment of this invention, collars 689 and mating bores 681 form frictional fits which allow for very fast mounting and demounting of archery accessories. It is apparent that adapter plate 677 could also be detachably secured to subplate 685 by other attachment means, such as adhesives, screws or any other suitable connector known to those skilled in the art.

According to one preferred embodiment of this invention, mounting apparatus 615 threadedly engages within locknut bore 650, and locknut 640 is set to fix mounting apparatus 615 with respect to adapter plate 677. In another preferred embodiment according to this invention, set screw 641 extends through locknut 640. As shown in FIG. 46, set screw 641 has a blunt end which abuts adapter plate 677 or any intermediate element. It is apparent that set screw 641 can also have a pointed end. With mounting apparatus 615 threadedly engaging locknut 640 and adapter plate 677 and locknut 640 rotated firmly against adapter plate 677, the three separate elements are fixed with respect to each other, and can be conveniently handled as an integral unit when mounting and demounting on bow handle-riser portion 610.

Typically, mounting and demounting archery accessories which extend into opening 611 requires rotating threaded mounting apparatus 615 within opening 611. It is apparent that each incremental rotation of mounting apparatus 615 changes the lateral position of an archery accessory, such as arrowrest 676. Because a slightly misaligned archery accessory can result in significant angular inaccuracies over a distance that an arrow is discharged from the archery bow, each time an archery accessory such as arrowrest 676 is demounted and remounted on an archery bow, the archer must laterally readjust and calibrate arrowrest 676. Adjustment of archery accessories can be time-consuming and tedious. The archery accessory adapter according to this invention eliminates this time-consuming and tedious readjustment process. Since locknut 640 fixes mounting apparatus 615 with respect to adapter plate 677, and adapter plate 677 is quickly and easily secured to bow handle-riser portion 610 according to this invention, the lateral position of the archery accessory does not change with each demounting and remounting on bow handle-riser portion 610.

Figure 47:
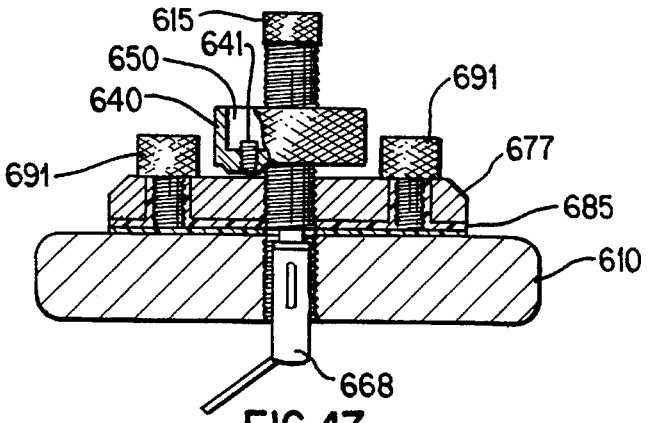
FIG. 47 is a partial cross-sectional top view of an assembled archery accessory adapter as shown in FIG. 46.

FIG. 47 shows the archery accessory adapter of FIG. 46, assembled and mounted on bow handle-riser portion 610. According to one preferred embodiment of this invention, the threads of mounting apparatus 615 do not engage the threads of bow handle-riser portion 610 within opening 611. Thus, the integral unit comprising adapter plate 677, mounting apparatus 615 and locknut 640 can be mounted on subplate 685 without rotating mounting apparatus 615, thereby maintaining a precise lateral position of mounting apparatus 615 after repeated demountings and remountings on bow handle-riser portion 610.

Figure 48:
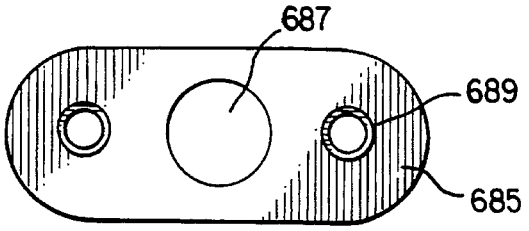
FIG. 48 is a front view of a subplate according to one preferred embodiment of this invention.

According to another preferred embodiment of this invention, subplate 685 is oval at two opposite ends, as shown in FIG. 48. Collars 689 are positioned on opposite sides of subplate bore 687. It is apparent that the shape of subplate 685 can deviate significantly from subplate 685 shown in FIG. 48. For instance, the shape of subplate 685 can be square, rectangular, circular, or nonsymmetrical. The primary consideration is that subplate 685 is attachable to bow handle-riser portion 610 and can be used to detachably secure adapter plate 677. In one preferred embodiment of this invention, one or a plurality of collars 689 can be used to secure adapter plate 677. Collars 689 can be of any suitable shape, especially if frictional fittings are used to secure adapter plate 677 to subplate 685. In another preferred embodiment of subplate 685 according to this invention, a suitable adhesive secures adapter plate 677 with respect to bow handle-riser portion 610.

Figure 49:
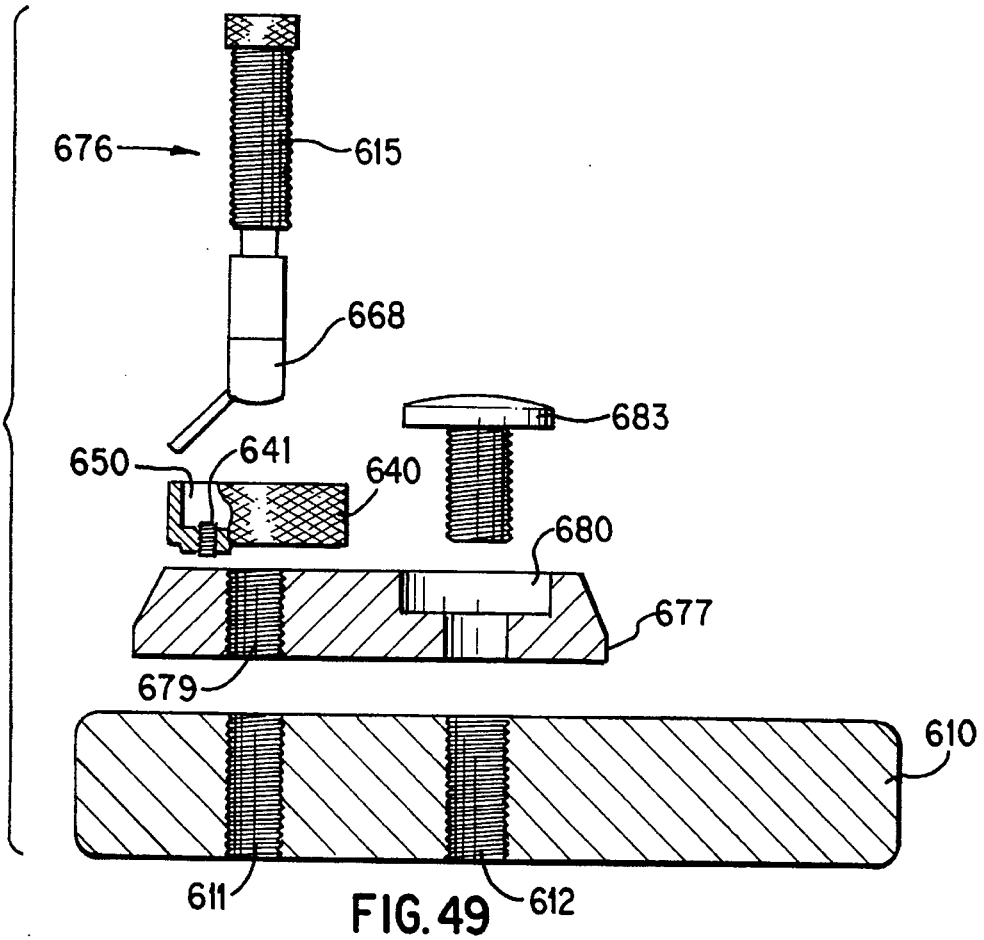
FIG. 49 is an exploded, partial cross-sectional top view of an archery accessory adapter, according to another preferred embodiment of this invention.

FIG. 49 shows another preferred embodiment of the archery accessory adapter according to this invention, preferably for use with archery bows having or modified to have two bowriser bores. Preferably, adapter screw 683 extends through second adapter bore 680 and threadedly engages the threads of bow handle-riser portion 610 within opening 612. It is apparent that adapter screw 683 can be a wing nut, or have a knurled or other machined surface so adapter screw 683 can be easily tightened and loosened by hand.

Figure 50:
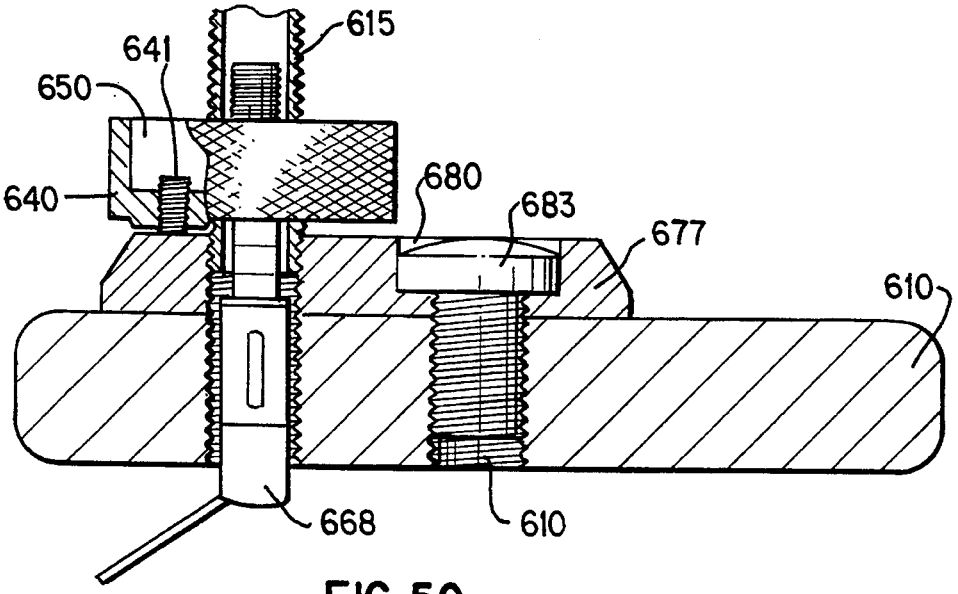
FIG. 50 is a partial cross-sectional top view of an assembled archery accessory adapter as shown in FIG. 49.

FIG. 50 shows the archery accessory adapter of FIG. 49 in an assembled and mounted position. Adapter plate 677, mounting apparatus 615, and locknut 640 can be demounted and remounted as an integral unit while maintaining mounting apparatus 615 in a precise lateral position when mounted on bow handle-riser portion 610. It is apparent that the head of adapter screw 683 need not be recessed in adapter plate 677 as shown in FIG. 50.

It is apparent that the many elements of each of FIGS. 1–51 as described above can be interchanged to enhance the versatility of this invention. The many embodiments shown in the drawings and described in this specification require mating connections between male and female elements as well as other elements shown in the drawings and described in the specification as having a particular shape. It is also apparent that male and female roles of each element can be interchanged in such embodiments and mirror images or mirror configurations of such other elements can be used to accomplish objectives of this invention without departing from the result of obtaining an instantly replaceable arrowrest.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An archery accessory adapter apparatus comprising:

an adapter plate forming an internally threaded plate bore;

a mounting shaft of an archery accessory, said mounting shaft mounted within said internally threaded plate bore; a locknut forming an internally threaded locknut bore and an internally threaded set screw bore, said mounting shaft positioned Within said internally threaded locknut bore, a set screw-threadedly engageable within said set screw bore, in a fixed position of said adapter plate with respect to said mounting shaft said set screw securing said locknut with respect to said adapter plate; and second securement means for detachably securing said adapter plate with respect to an archery bowriser.

2. An archery accessory adapter apparatus according to claim 1, wherein in said fixed position said set screw abuts said adapter plate.

3. An archery accessory adapter apparatus according to claim 4, wherein an external surface of said locknut is knurled.

4. An archery accessory adapter apparatus according to claim 1, wherein said second securement means comprise:

a subplate forming a subplate bore;

subplate securement means for securing said subplate to said archery bowriser; and adapter plate securement means for detachably securing said adapter plate to said subplate.

5. An archery accessory adapter apparatus according to claim 4, wherein said subplate securement means comprise an adhesive in contact with at least one of said subplate and said archery bowriser.

6. An archery accessory adapter apparatus comprising:

an adapter plate foxing an internally threaded plate bore and an adapter bore;

a mounting shaft of an archery accessory, said mounting shaft mounted within said internally threaded plate bore;

an archery bowriser having a bowriser accessory bore and a bowriser adapting bore;

said archery accessory positioned within said bowriser accessory bore;

first securement means for securing said adapter plate in a fixed position with respect to said mounting shaft; and plate securement means for detachably securing said adapter plate with respect to said archery bowriser.

7. An archery accessory adapter apparatus according to claim 6, wherein said plate securement means comprise an adapter screw, said adapter screw extending through said adapter bore and engageable within said bowriser adapting bore.

8. An archery accessory adapter apparatus comprising:

an adapter plate forming an internally threaded plate bore;

a mounting shaft of an archery accessory, said mounting shaft mounted within said internally threaded plate bore;

first securement means for securing said adapter plate in a fixed position with respect to said mounting shaft;

a subplate forming a subplate bore;

subplate securement means for securing said subplate to an archery bowriser;

at least one externally threaded collar extending from said subplate, said adapter plate forming at least one mating bore, said at least one externally threaded collar extending through said at least one mating bore; and at least one thumbscrew threadedly engaging said at least one externally threaded collar and detachably securing said adapter plate to said subplate.

9. An archery accessory adapter apparatus according to claim 8, wherein an exterior of said at least one thumbscrew is knurled.

10. An archery accessory adapter apparatus comprising:

an adapter plate forming an internally threaded plate bore;

a mounting shaft of an archery accessory, said mounting shaft mounted within said internally threaded plate bore;

first securement means for securing said adapter plate in a fixed position with respect to said mounting shaft;

a subplate forming a subplate bore;

subplate securement means for securing said subplate to an archery bowriser;

at least one internally threaded collar extending from said subplate, said adapter plate forming at least one mating bore, said at least one internally threaded collar extending through said at least one mating bore; and at least one nut threadedly engaging said at least one internally threaded collar and detachably securing said adapter plate to said subplate.

11. An archery accessory adapter apparatus according to claim 10, wherein an exterior of said at least one nut is knurled.

12. An archery accessory adapter apparatus according to claim 10, wherein said subplate securement means comprise an adhesive in contact with at least one of said subplate and said archery bowriser.

* * * * *